US008438705B2

(12) United States Patent
Wang

(10) Patent No.: US 8,438,705 B2
(45) Date of Patent: May 14, 2013

(54) DOUBLE LAYER ZIPPER WITH TADPOLE-SHAPED INTERLOCKING TEETH

(76) Inventor: Lien-Chou Wang, New Taipei (TW)

( * ) Notice: Subject to any disclaimer, the term of this patent is extended or adjusted under 35 U.S.C. 154(b) by 219 days.

(21) Appl. No.: 13/095,003

(22) Filed: Apr. 27, 2011

(65) Prior Publication Data

US 2012/0272488 A1 Nov. 1, 2012

(51) Int. Cl.
*A44B 19/12* (2006.01)
*A44B 19/26* (2006.01)

(52) U.S. Cl.
USPC ..... 24/394; 24/415; 24/426

(58) Field of Classification Search ..... None
See application file for complete search history.

(56) References Cited

U.S. PATENT DOCUMENTS 3,854,174 A * 12/1974 Yoshida ..... 24/394
4,601,085 A * 7/1986 Yoshida et al. ..... 24/384
5,129,127 A * 7/1992 Hamatani ..... 24/394

* cited by examiner

*Primary Examiner* — Jack W. Lavinder
(74) *Attorney, Agent, or Firm* — Jackson IPG PLLC

(57) ABSTRACT

A double layer zipper includes two zipper tapes, each zipper tape having a seal strip covered on transverse top and bottom edges and one longitudinal side edge thereof and stitched with the associating interlocking series of teeth, and an interlocking series of teeth formed of a series of coils and respectively fastened to each of opposing top and bottom sides of each of the zipper tapes, each coil having a coil head and a coil body connected to the front side of the coil head, the coil body having a recessed face disposed adjacent to the associating coil head, two flank portions disposed at two opposite lateral sides of the recessed face and a neck connected between the recessed face and associating coil head so that each coil has a tadpole-shaped profile.

6 Claims, 15 Drawing Sheets

DOUBLE LAYER ZIPPER WITH TADPOLE-SHAPED INTERLOCKING TEETH

BACKGROUND OF THE INVENTION

1. Field of the Invention

The present invention relates to zippers and more particularly, to a double layer zipper with tadpole-shaped interlocking teeth that comprises an interlocking series of teeth formed of a left-handed or right-handed series of coils and disposed at each of opposing top and bottom sides of each of two zipper tapes thereof, a seal strip extending along the longitudinal outer side edge of each zipper tape, and a slider equipped with rollers for closing/opening the interlocking series of teeth at the two zipper tapes.

2. Description of the Related Art

A conventional nylon zipper generally comprises two zipper tapes and an interlocking series of teeth at each of the two zipper tapes. Each interlocking series of teeth comprises a left-handed or right-handed series of nylon coils 5. Each nylon coil 5 comprises a coil head 51 and a coil body 52 connected to the front side of the coil head 51. When this nylon zipper tape is closed, the two interlocked series of teeth will not be opened upon a transverse stretching force. However, a potential thief can insert a pointed object, for example, the tip of a ball pen, into a gap between the meshed teeth of the two interlocked series of teeth to separate the two series of teeth. Thus, this structure of nylon zipper has a low level of security when used in a bag or case.

China Patent ZL20082008275716 discloses a double layer zipper that eliminates the drawbacks of the aforesaid conventional nylon zipper. This design of double layer zipper has a high level of safety when used in a bag, case or tent. However, this design of double layer zipper still has room for improvement. For example, it cannot prohibit permeation of external water or moisture.

SUMMARY OF THE INVENTION

The present invention has been accomplished under the circumstances in view. It is therefore the main object of the present invention to provide a double layer zipper with tadpole-shaped interlocking teeth, which has high engagement strength against transverse stretching force or external impact at the corner area, avoiding disengagement of the interlocked series of teeth.

It is another object of the present invention to provide a double layer zipper with tadpole-shaped interlocking teeth, which has the opposing top and bottom edges and one longitudinal side edge of each of the two zipper tapes thereof covered with a respective flexible seal strip so that when the interlocked series of teeth at the two zipper tapes are meshed together, the flexible seal strip at one zipper tape is stopped against the flexible seal strip at the other zipper tape, enhancing the engagement strength of the interlocking series of teeth and prohibiting permeation of external water and moisture, and therefore the double layer zipper of the invention has waterproof, airtight, disengagement-preventive and anti-piercing characteristics.

It is another object of the present invention to provide a double layer zipper with tadpole-shaped interlocking teeth, which is equipped with a specially designed zipper slider that has rollers pivotally mounted in each of the opposing top and bottom guard frame walls thereof for guiding the interlocking series of teeth at the two zipper tapes into positive engagement with less friction resistance.

DETAILED DESCRIPTION OF THE INVENTION

Figure 1:
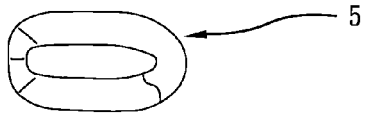
Fig. 1 PRIOR ART
FIG. 1 is a front view of an interlocking series of coil-type nylon teeth according to the prior art.
Figure 2:
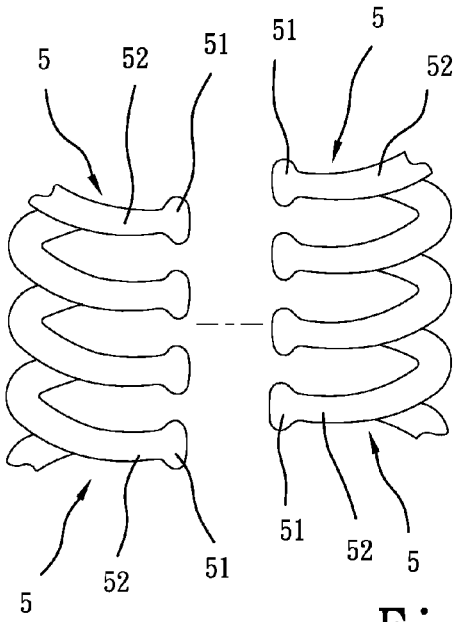
Fig. 2 PRIOR ART
FIG. 2 is a top view of a left-handed series of coil-type nylon teeth and a right-handed series of coil-type nylon teeth according to the prior art.
Figure 3:
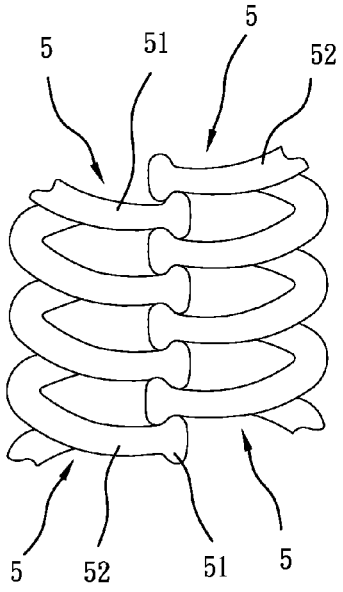
Fig. 3 PRIOR ART
FIG. 3 is a plain view illustrating the left-handed series of coil-type nylon teeth and the right-handed series of coil-type nylon teeth interlocked according to the prior art.
Figure 4:
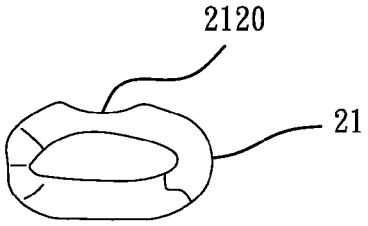
FIG. 4 is a front view of a tadpole-shaped coil element of an interlocking series of coil for double layer zipper according to a first embodiment of the present invention.
Figure 5:
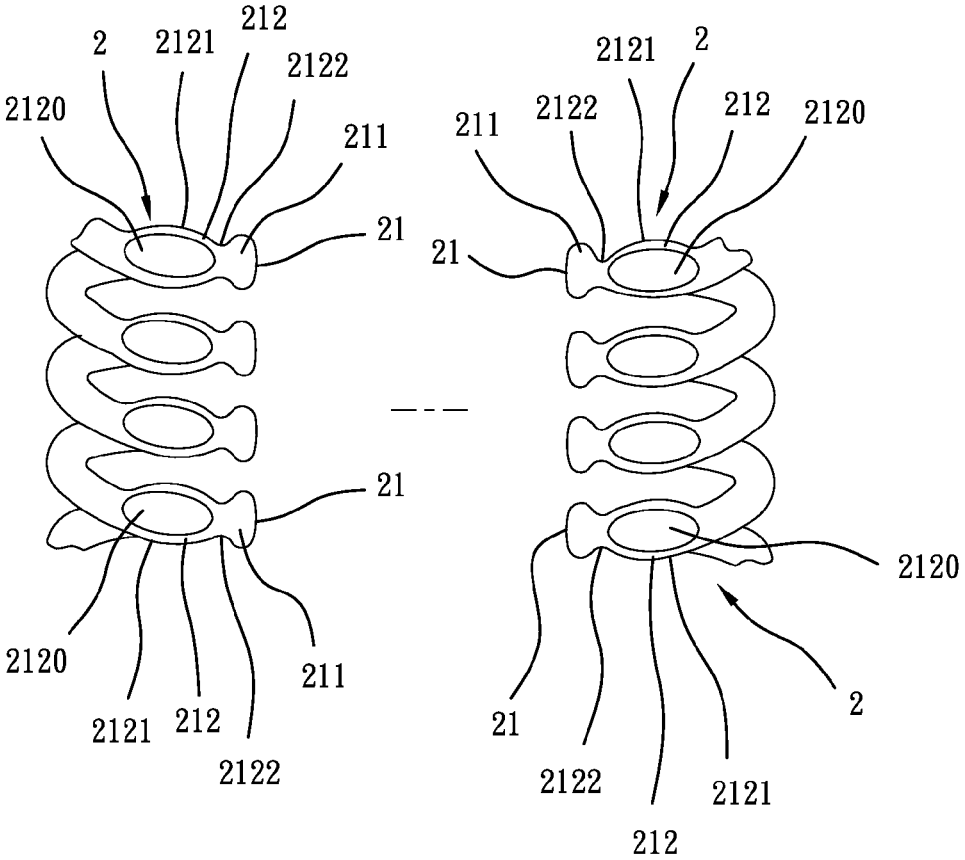
FIG. 5 is a top view of a left-handed series of teeth and a right-handed series of teeth for double layer zipper according to the first embodiment of the present invention.
Figure 6:
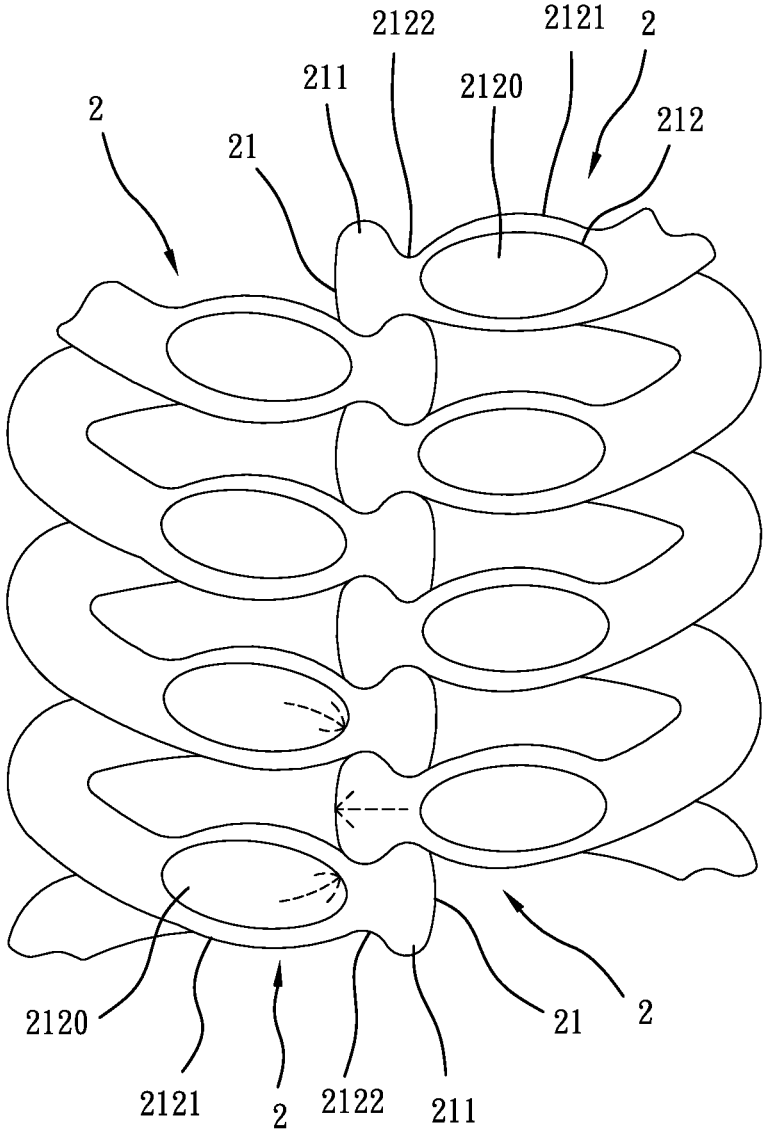
FIG. 6 is an enlarged plain view illustrating the left-handed series of teeth and the right-handed series of teeth interlocked according to the first embodiment of the present invention.
Figure 7:
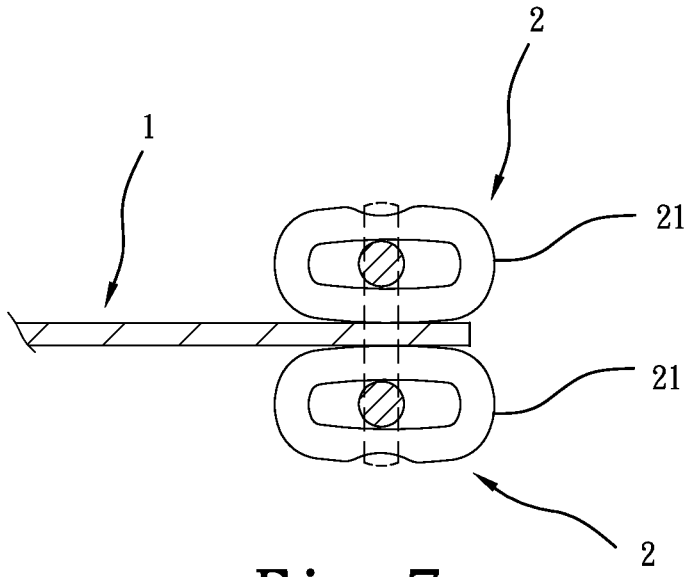
FIG. 7 is a schematic sectional view of a part of the first embodiment of the present invention, illustrating the arrangement of the interlocking series of teeth at the top and bottom sides of one zipper tape of the double layer zipper.
Figure 8:
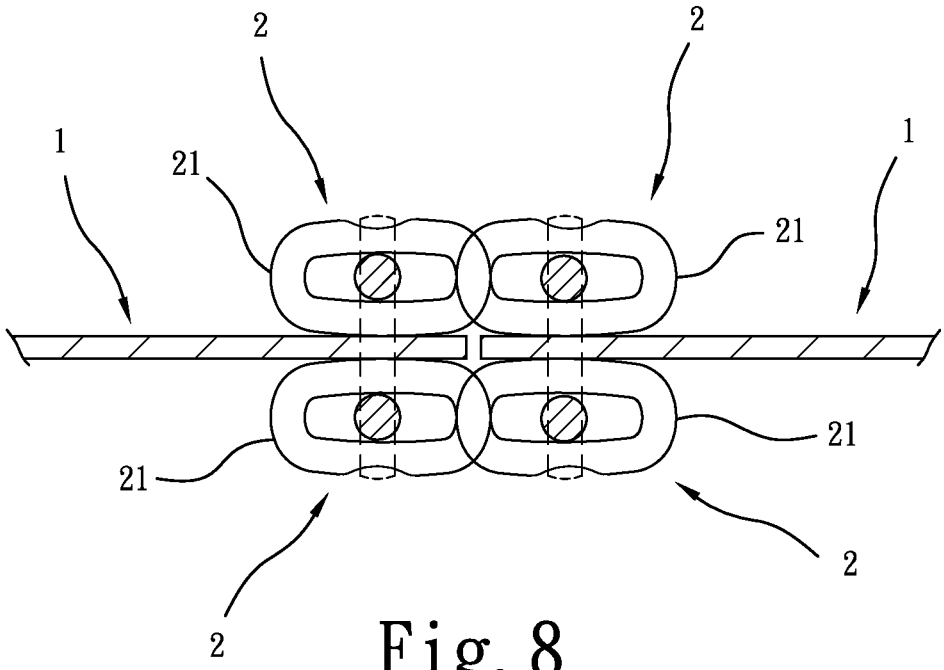
FIG. 8 is a schematic sectional view of the double layer zipper according to the first embodiment of the present invention.

Referring to FIGS. 7 and 8, a double layer zipper with tadpole-shaped interlocking teeth in accordance with a first embodiment of the present invention is shown comprising two zipper tapes 1, and an interlocking series of teeth 2 at each of opposing top and bottom sides of each of the two zipper tapes 1. Each interlocking series of teeth 2 comprises a left-handed or right-handed series of coils 21 (see FIG. 5 and FIG. 6). Each coil element 21 of the left-handed or right-handed series of coils 21 comprises a coil head 211 and a coil body 212 connected to the front side of the coil head 211. Further, the coil heads 211 and coil bodies 212 of the left-handed and right-handed series of coils 21 are respectively interlocked (see FIG. 6).

The main features of the invention are outlined hereinafter.

The coil body 212 comprises a recessed face 2120 disposed adjacent to the associating coil head 211, two flank portions 2121 disposed at two opposite lateral sides of the recessed face 2120, and a neck 2122 connected between the recessed face 2120 and associating coil head 211. Thus, each coil element 21 has a tadpole-shaped profile. When the left-handed and right-handed series of coils 21 are fastened together, the coil heads 211 of one of the left-handed and right-handed series of coils 21 are respectively retained between each the necks 2122 of each two adjacent coil elements 21 of the other one of the left-handed and right-handed series of coils 21. When stretching the left-handed and right-handed series of coils 21 of the interlocking series of teeth 2 transversely outwards in reversed directions, the coil heads 211 of the left-handed series of coils 21 are engaged with the coil heads 211 of the right-handed series of coils 21, avoiding separation. When pushing the left-handed and right-handed series of coils 21 of the interlocking series of teeth 2 toward each other, the coil heads 211 of the coil elements 21 of one of the left-handed and right-handed series of coils 21 will be stopped by the flank portions 2121 of the coil elements 21 of the other one of the left-handed and right-handed series of coils 21 (see imaginary arrowhead signs in FIG. 6). Thus, when stitching the respective interlocking series of teeth 2 to the respective zipper tapes 1, the interlocking series of teeth 2 will not be loosened. When two interlocking series of teeth 2 are stitched to the top and bottom sides of each of the two zipper tapes 1, the interlocking series of teeth 2 of the two zipper tapes 1 are interlocked subject to sliding operation of a slide (not shown), forming a double layer zipper (see FIG. 8) for application like a regular double layer metal or plastic zipper. After fixation of the zipper tapes 1 of the double layer zipper of the present invention to respective fabric or leather sheet members of a case or tent and engagement between the interlocking series of teeth 2 at the two zipper tapes 1, the interlocking series of teeth 2, even at the corner area, will not be disengaged accidentally upon an external force either upwardly from the bottom side or downwardly from the top side. When the left-handed and right-handed series of coils 21 of the two interlocking series of teeth 2 at the top side of the zipper tapes 1 are pushed by an external protruding object, they may be forced to curve downward, however, the left-handed and right-handed series of coils 21 of the interlocking series of teeth 2 at the bottom side of the zipper tapes 1 give a support at this time, avoiding excessive deformation or accidental disengagement of the interlocked series of teeth 2. Therefore, the double layer zipper of the invention has high engagement strength against transverse stretching force or external impact at the corner area, avoiding disengagement of the interlocked series of teeth 2 (see FIG. 8).

Figure 9:
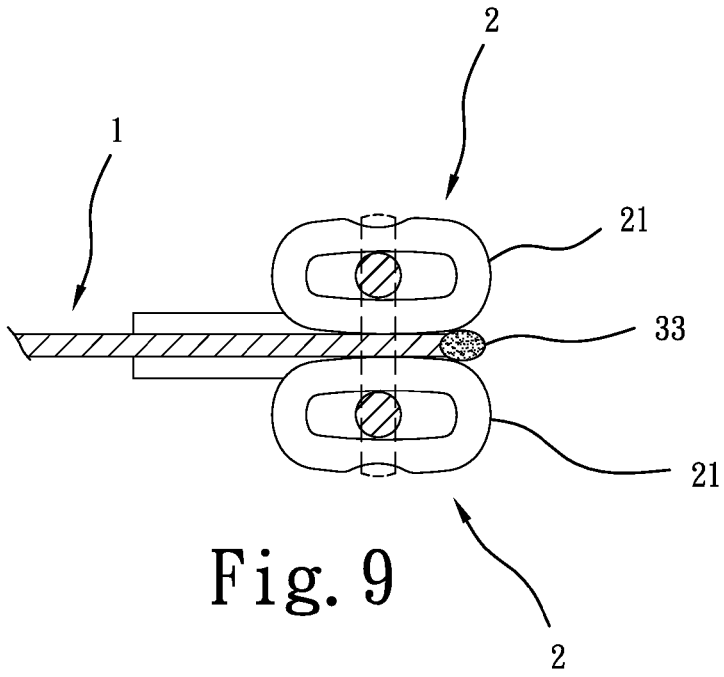
FIG. 9 is a schematic sectional view of a part of a second embodiment of the present invention, illustrating the arrangement of the interlocking series of teeth at the top and bottom sides of one zipper tape of the double layer zipper.
Figure 10:
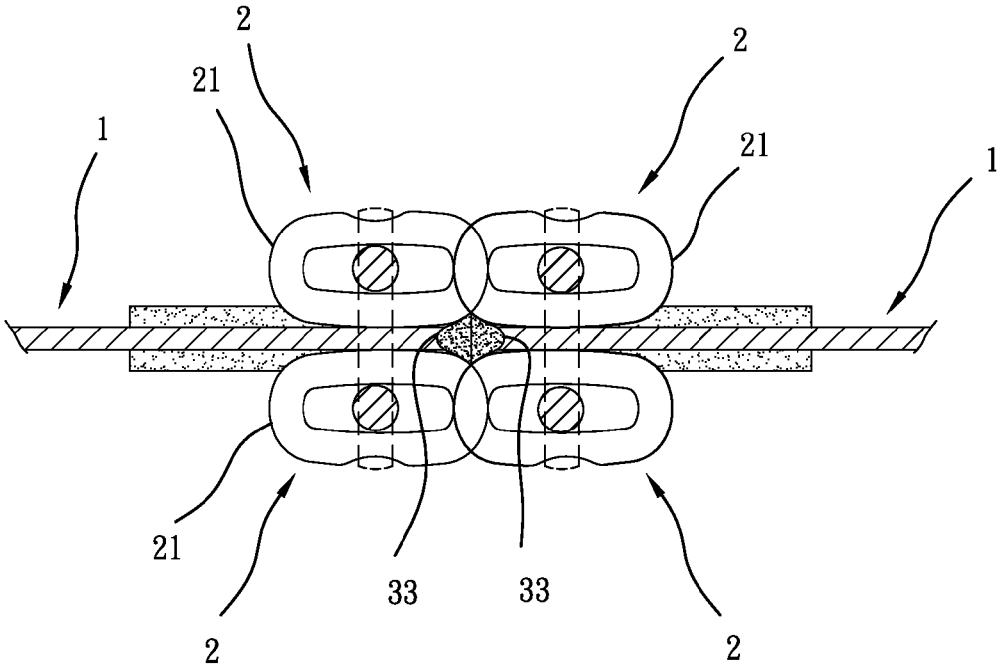
FIG. 10 is a schematic sectional view of the double layer zipper according to the second embodiment of the present invention.

FIGS. 9 and 10 illustrate a double layer zipper with tadpole-shaped interlocking teeth in accordance with a second embodiment of the present invention. This second embodiment further comprises a flexible seal strip 33 molded on the longitudinally extended external side edge of each of the two zipper tapes 1 between the two interlocking series of teeth 2 at the top and bottom sides of each of the two zipper tapes 1 (see FIG. 10). The flexible seal strip 33 can be made having a circular, oval or rectangular profile. According to this embodiment, the flexible seal strip 33 has a substantially C-shaped cross section. When operating the zipper slide (not shown) to fasten up the interlocking series of teeth 2 at the top and bottom sides of the two zipper tapes 1, the flexible seal strip 33 at one zipper tape 1 is abutted against the flexible seal strip 33 at the other zipper tape 1, enhancing the engagement strength of the interlocking series of teeth 2 and prohibiting permeation of external water and moisture.

Figure 11:
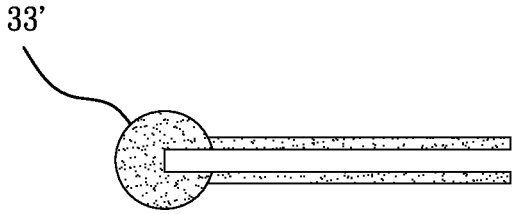
FIG. 11 is a schematic plain view of a U-shaped seal strip extruded from flexible plastic resins for double layer zipper according to the second embodiment of the present invention.
Figure 12:
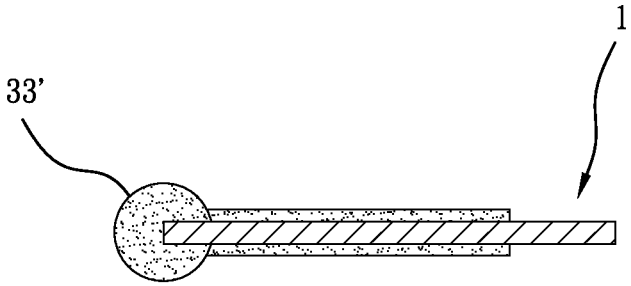
FIG. 12 is a schematic plain view illustrating a U-shaped seal strip stitched to one zipper tape according to the second embodiment of the present invention.
Figure 13:
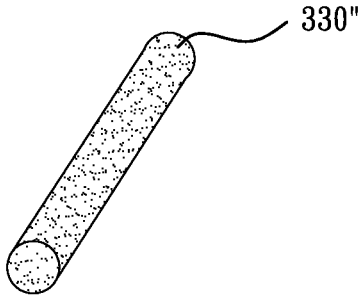
FIG. 13 is a schematic plain view of a cylindrical flexible plastic wire rod extruded from flexible plastic resins for double layer zipper according to the second embodiment of the present invention.
Figure 14:
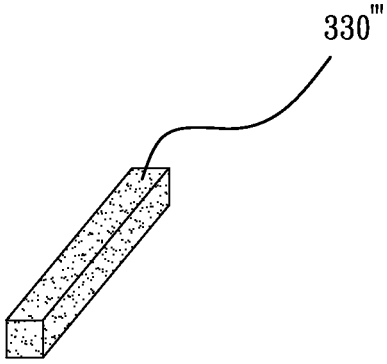
FIG. 14 is a schematic plain view of a rectangular flexible plastic wire rod extruded from flexible plastic resins for double layer zipper according to the second embodiment of the present invention.
Figure 15:
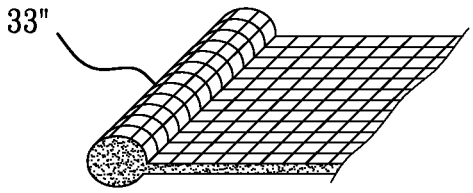
FIG. 15 is a schematic drawing illustrating a cylindrical flexible plastic wire rod woven with a zipper tape for double layer zipper according to the second embodiment of the present invention.
Figure 16:
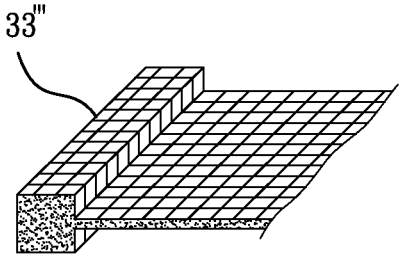
FIG. 16 is a schematic drawing illustrating a rectangular flexible plastic wire rod woven with a zipper tape for double layer zipper according to the second embodiment of the present invention.

Further, instead of the aforesaid flexible seal strip 33, flexible seal strips 33' having a substantially C-shaped or U-shaped cross section can be extruded from a flexible plastic resin (see FIG. 11) and then respectively rolled up into a roll for fixation to one longitudinal side edge of each of the two zipper tapes 1 with stitches (see FIG. 12); alternatively, flexible plastic resins can be extruded into cylindrical flexible plastic wire rods 330" (see FIG. 13) or rectangular flexible plastic wire rods 330''' (see FIG. 14), and then fastened to one longitudinal side edge of each of the two zipper tapes 1 during weaving of the zipper tapes 1 (see FIG. 15 and FIG. 16), and then fixedly mounted with the top and bottom interlocking series of teeth 2 after receiving a film-coating treatment. Further, when weaving the zipper tapes 1, the threads can be twisted into a cord to seal the outer side edge of each zipper tape. Further, filament fibers may be left at one longitudinal side edges of each zipper tape 1 after its weaving, and then two interlocking series of teeth 2 are stitched to the top and bottom sides of each of the two zipper tapes 1, and then the zipper tapes 1 are processed through a dying process, a coating process and a drying process. A double layer zipper thus made has waterproof, airtight and disengagement-preventive characteristics.

Further, the aforesaid seal strips 33;33';33";33''' can be made by flexible plastics or rubber. Further, the zipper tapes 1 can be mounted with one respective seal bar 33;33', and then fastened up with the respective interlocking series of teeth 2, and then colored and treated with a film-coating process and then treated through a drying process. A double layer zipper made in either of the aforesaid methods has waterproof, airtight, disengagement-preventive and anti-piercing characteristics.

Figure 17:
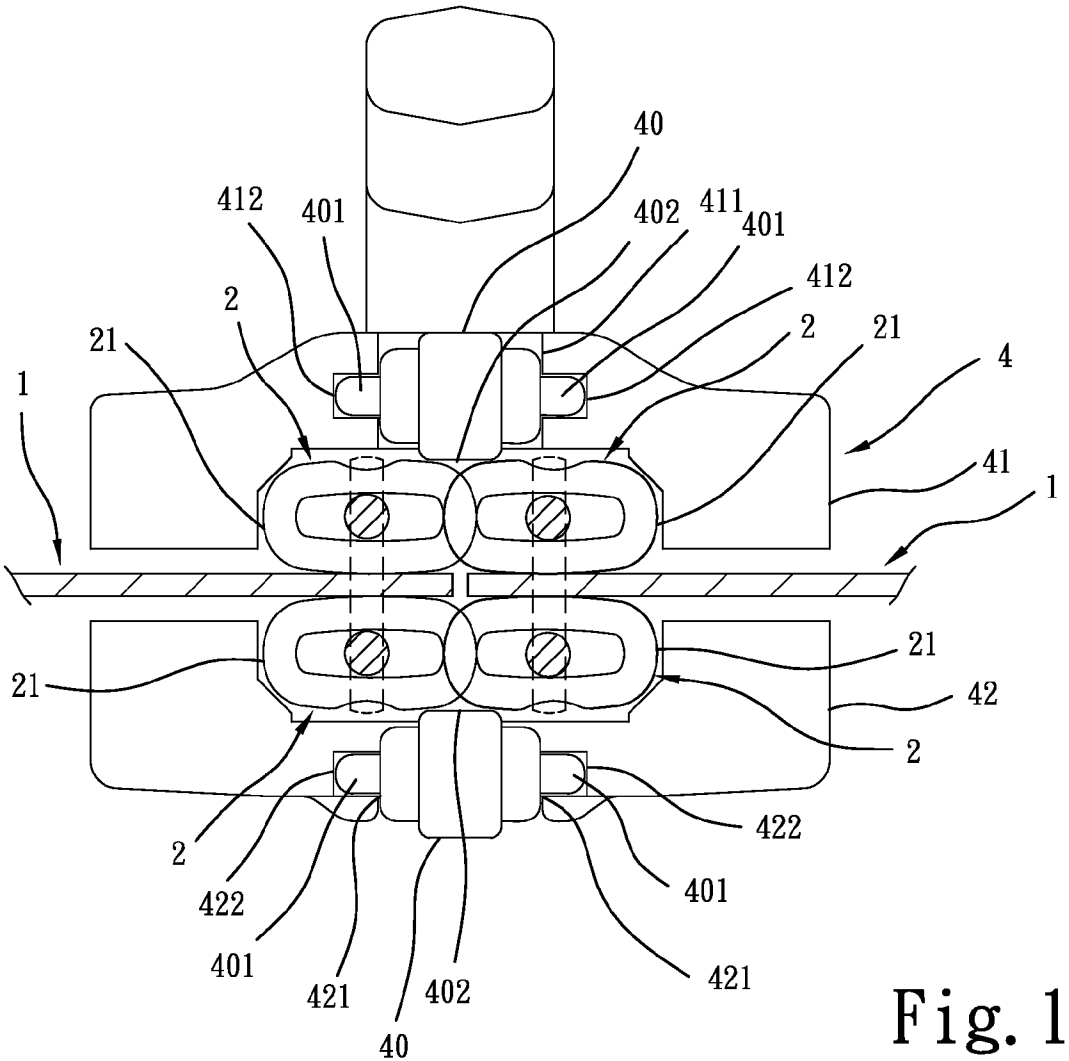
FIG. 17 is a schematic sectional view of a part of a double layer zipper according to a third embodiment of the present invention.
Figure 18:
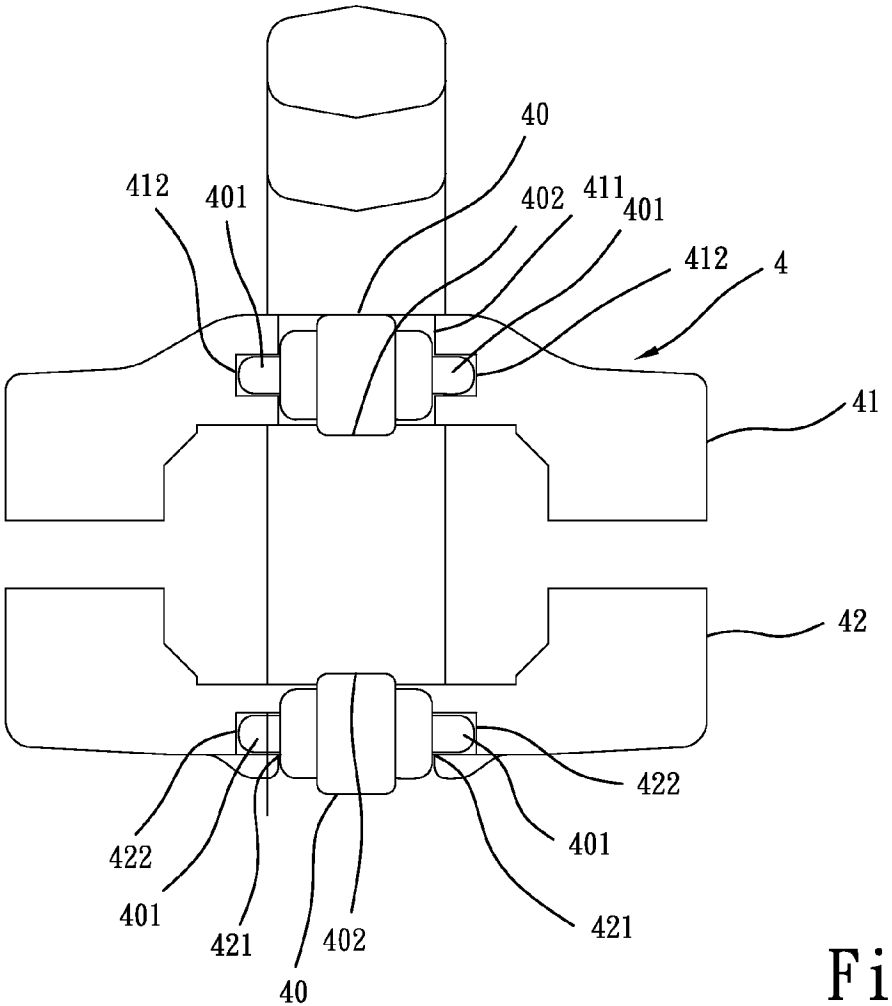
FIG. 18 is a front view, in an enlarged scale, of the slider of the double layer zipper shown in FIG. 17.
Figure 20:
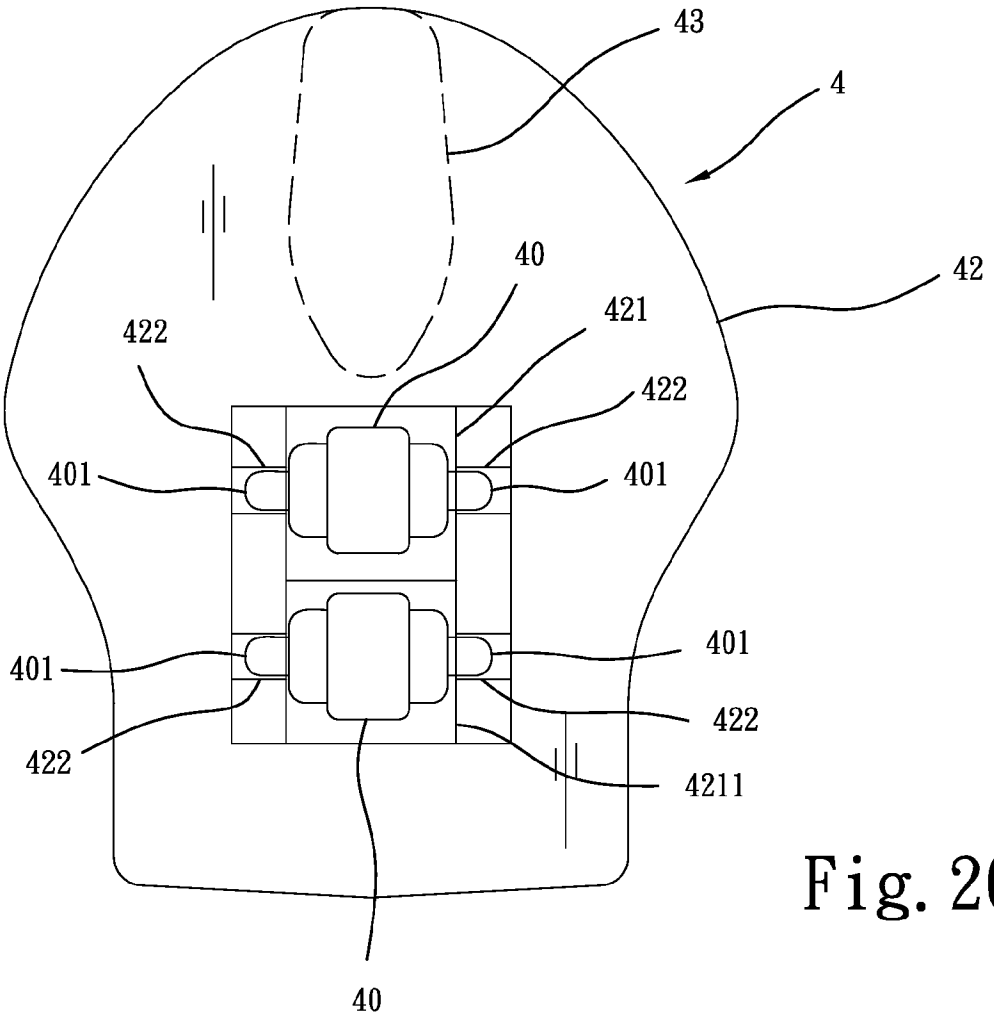
FIG. 20 is a rear view, in an enlarged scale, of the slider of the double layer zipper shown in FIG. 17.
Figure 21:
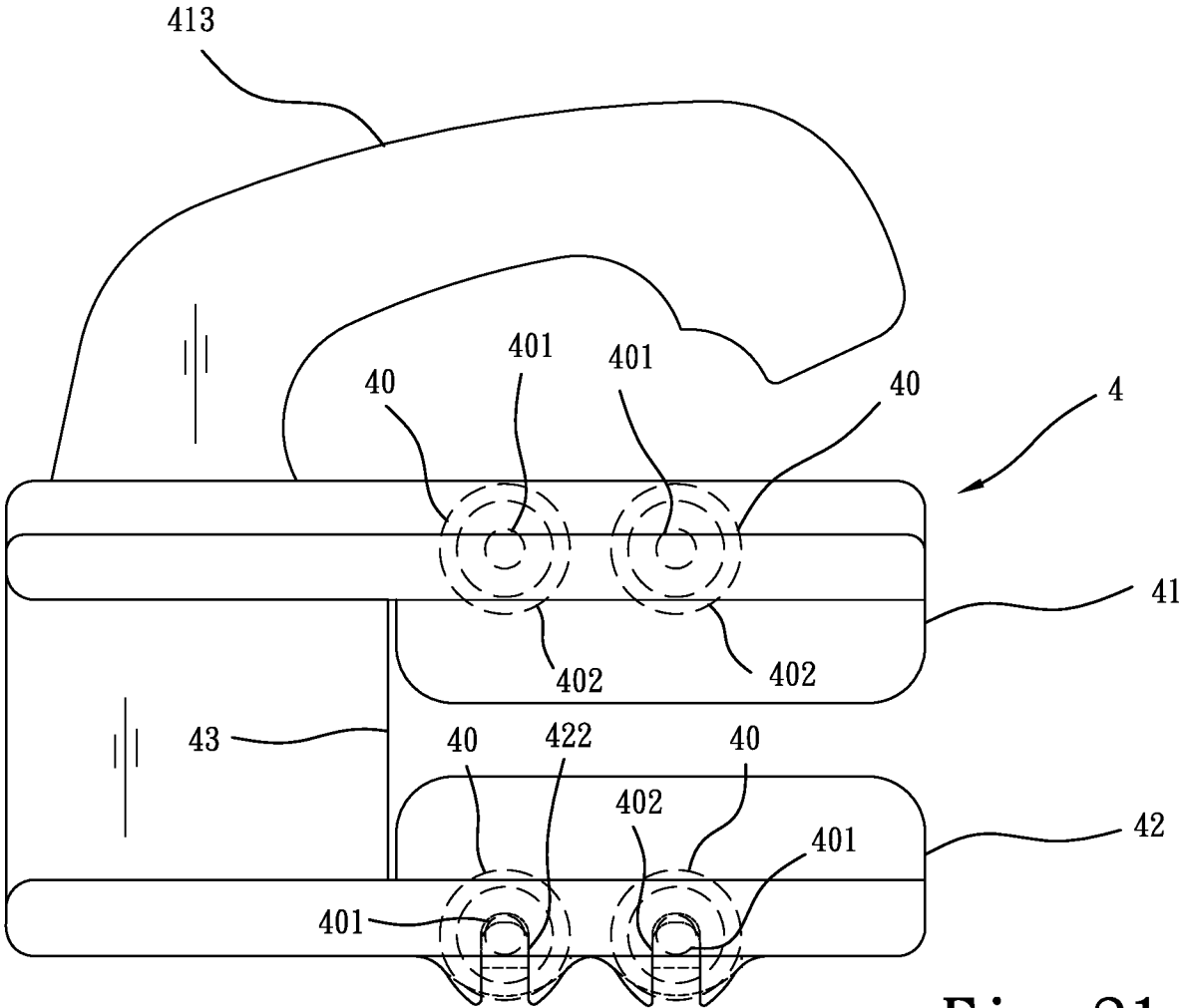
FIG. 21 is a schematic side view of the third embodiment of the present invention before shape-setting of the nose of the zipper slider.
Figure 22:
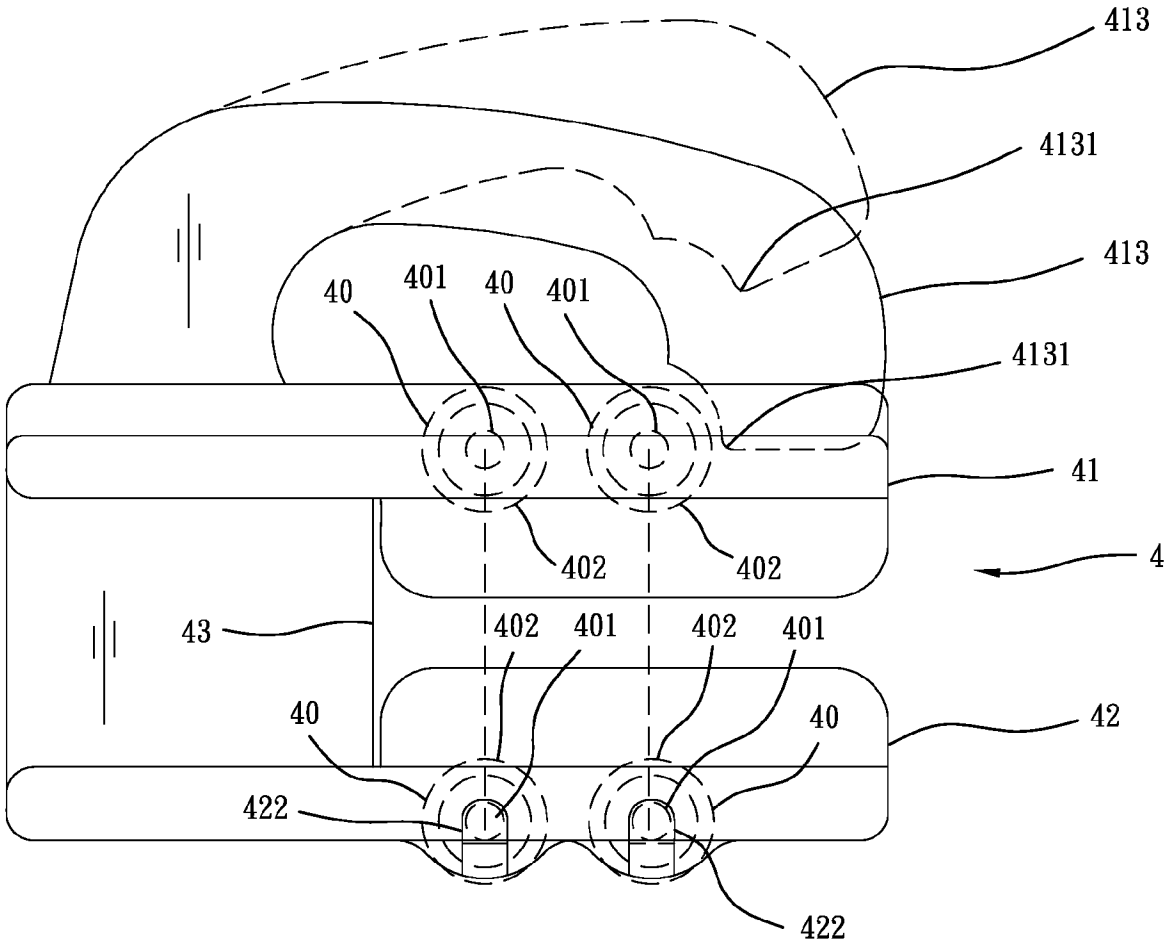
FIG. 22 corresponding to FIG. 21, illustrating the nose of the zipper slider set into shape.

Further, in order to facilitating closing and unclosing of the double layer zipper, the invention provides an improved zipper slider. As illustrated in FIG. 17, a double layer zipper in accordance with a third embodiment of the present invention further comprises a zipper slider 4. The zipper slider 4 comprises opposing top guard frame wall 41 and bottom guard frame wall 42, a division wall 43 vertically connected between the top guard frame wall 41 and the bottom guard frame wall 42 (see FIGS. 20-22), a nose 413 located on the top side of the top guard frame wall 41, two openings 411;421 respectively cut through the top guard frame wall 41 and the bottom guard frame wall 42, a plurality of pivot holes 412;422 respectively formed in the top guard frame wall 41 and the bottom guard frame wall 42 and kept in communication with the respective openings 411;421 at two opposite lateral sides, and a plurality of rollers 40 respectively symmetrically accommodated in the openings 411;421 and having the respective roller axles 401 respectively pivotally coupled to the pivot holes 412;422 in the top guard frame wall 41 and the bottom guard frame wall 42. Thus, a gap of a predetermined height is defined between the rollers 40 at the top guard frame wall 41 and the rollers 40 at the bottom guard frame wall 42 for the passing of the interlocking series of teeth 2 in the interlocked condition smoothly, reducing friction resistance.

Figure 19:
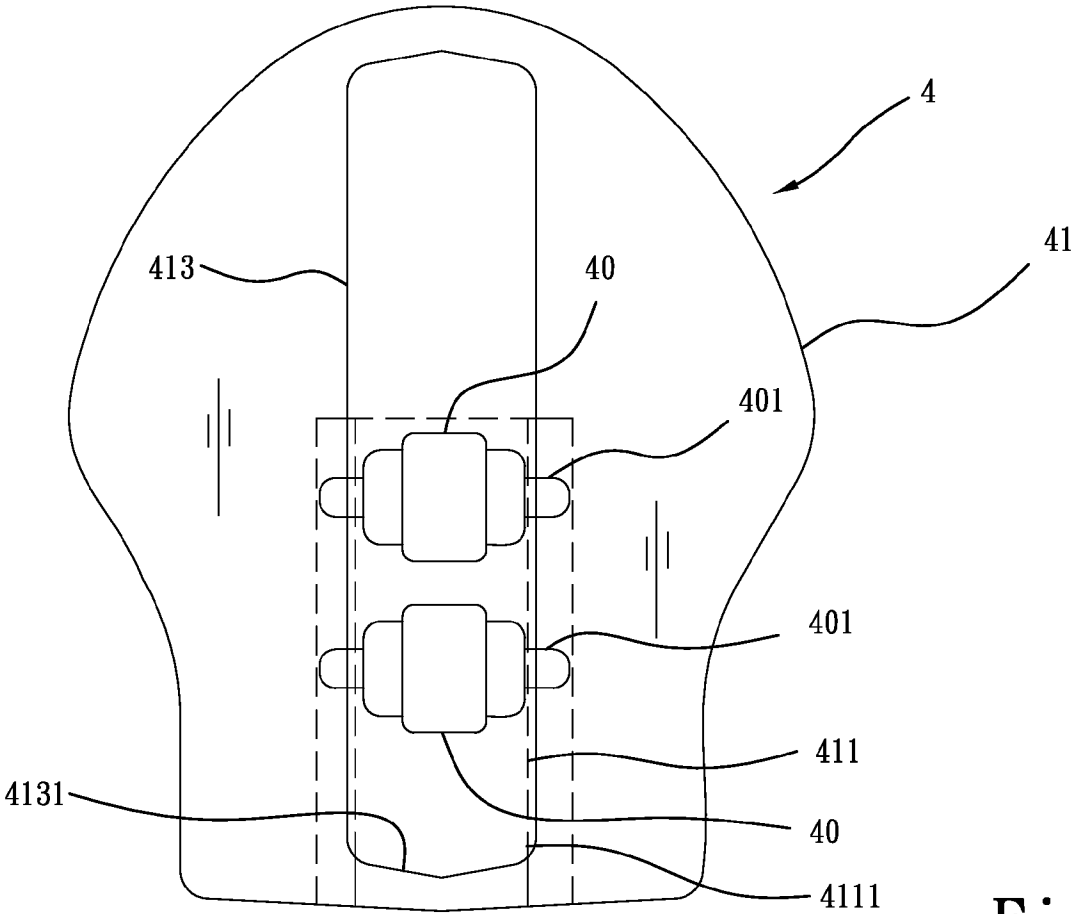
FIG. 19 is a top view, in an enlarged scale, of the slider of the double layer zipper shown in FIG. 17.

Further, the front bottom edge 4131 of the nose 413 of the zipper slider 4 (see FIG. 22) is stopped at the front side 4111 of the opening 411 in the top guard frame wall 41 (see FIG. 19), preventing falling of the respective rollers 40 out of the top guard frame wall 41. The front end 4211 of the opening 421 in the bottom guard frame wall 42 is a close end or flanged, preventing falling of the respective rollers 40 out of the bottom guard frame wall 42. Further, the rollers 40 are symmetrically arranged in the top guard frame wall 41 and the bottom guard frame wall 42 in pairs, i.e., the rollers 40 in the top guard frame wall 41 are respectively kept in vertical alignment with the rollers 40 in the bottom guard frame wall 42.

Figure 23:
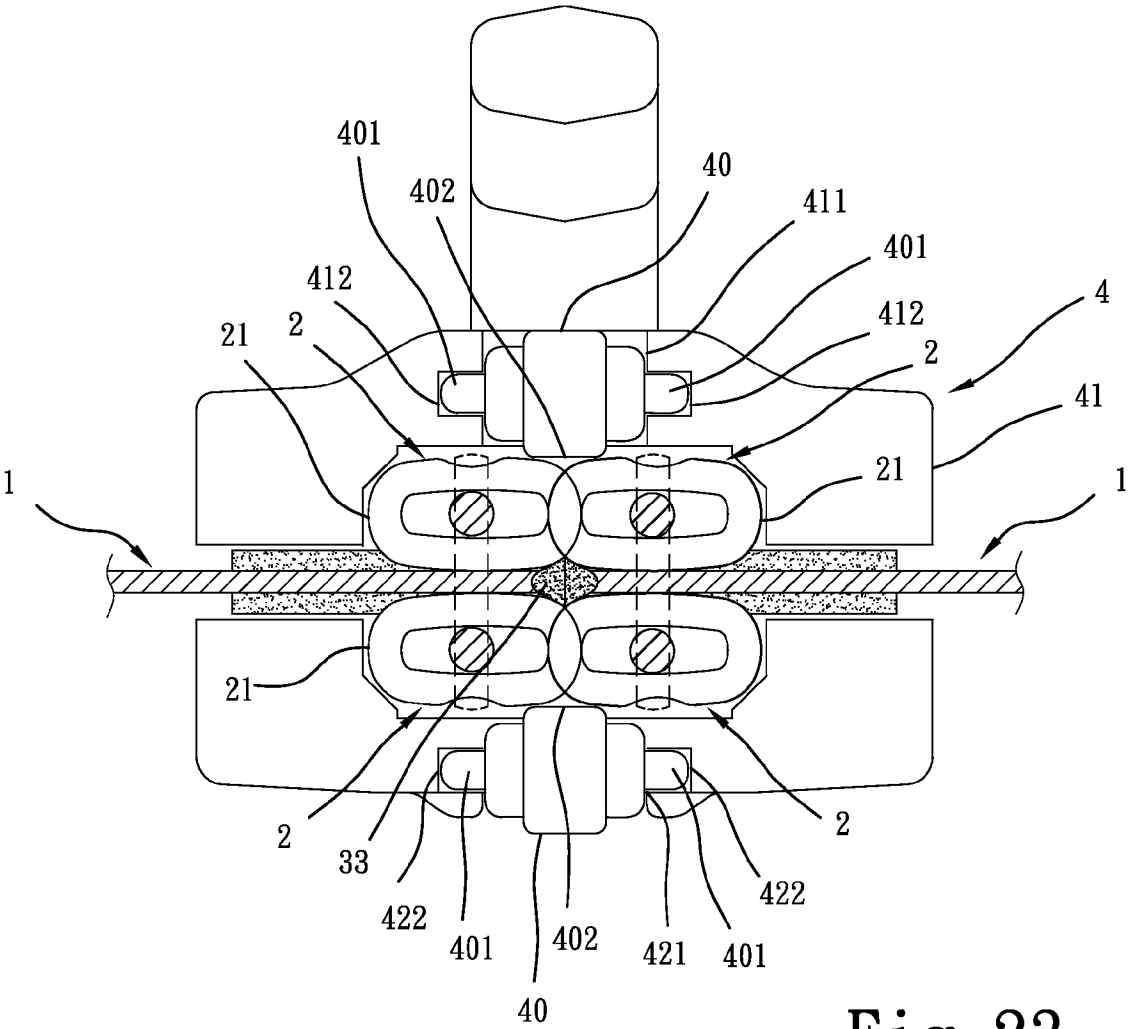
FIG. 23 is a schematic sectional assembly view of a double layer zipper in accordance with a fourth embodiment of the present invention.

FIG. 23 illustrates a double layer zipper with tadpole-shaped interlocking teeth in accordance with a fourth embodiment of the present invention. This fourth embodiment is substantially similar to the aforesaid third embodiment with the exception that: each zipper tape 1 has its transverse top and bottom edges and one longitudinal side edge covered with one respective flexible seal strip 33 by means of an extrusion machine at first, and then top and bottom interlocking series of teeth 2 are stitched to the top and bottom sides of each of the two zipper tapes 1, and then the zipper slide 4 constructed according to the aforesaid third embodiment is coupled to the interlocking series of teeth 2 at the two zipper tapes 1, keeping the treads 402 of the rollers 40 in the top guard frame wall 41 of the zipper slide 4 in contact with the interlocking series of teeth 2 at the top side of each of the two zipper tapes 1 and the rollers 40 in the bottom guard frame wall 42 of the zipper slide 4 in contact with the interlocking series of teeth 2 at the bottom side of each of the two zipper tapes 1. Subject to the functioning of the rollers 40, the interlocking series of teeth 2 at the two zipper tapes 1 can be closed or opened smoothly and stably with less friction resistance.

In conclusion, the double layer zipper with tadpole-shaped interlocking teeth in accordance with the present invention has the following features and advantages:

1. After fixation of the zipper tapes 1 of the double layer zipper to respective fabric or leather sheet members of a case or tent and engagement between the interlocking series of teeth 2 at the two zipper tapes 1, the interlocking series of teeth 2, even at the corner area, will not be disengaged accidentally upon an external force either upwardly from the bottom side or downwardly from the top side. When the left-handed and right-handed series of coils 21 of the interlocking series of teeth 2 at the upper side of the zipper tapes 1 are forced by an external protruding object, they may be forced to curve downward, however, the left-handed and right-handed series of coils 21 of the interlocking series of teeth 2 at the bottom side of the zipper tapes 1 give a support at this time, avoiding excessive deformation or accidental disengagement of the interlocked series of teeth 2. Therefore, the double layer zipper of the invention has high engagement strength against transverse stretching force or external impact at the corner area, avoiding disengagement of the interlocked series of teeth 2.
2. When the interlocked series of teeth 2 at the two zipper tapes 1 are meshed together, the flexible seal strip 33 at one zipper tape 1 is stopped against the flexible seal strip 33 at the other zipper tape 1, enhancing the engagement strength of the interlocking series of teeth 2 and prohibiting permeation of external water and moisture, and therefore the double layer zipper of the invention has waterproof, airtight, disengagement-preventive and anti-piercing characteristics.
3. The zipper slider 4 of the double layer zipper comprises opposing top guard frame wall 41 and bottom guard frame wall 42, a division wall 42 vertically connected between the top guard frame wall 41 and the bottom guard frame wall 42, nose 413 located on the top side of the top guard frame wall 41, two openings 411;421 respectively cut through the top guard frame wall 41 and the bottom guard frame wall 42, a plurality of pivot holes 412;422 respectively formed in the top guard frame wall 41 and the bottom guard frame wall 42 and kept in communication with the respective openings 411;421 at two opposite lateral sides, and a plurality of rollers 40 respectively symmetrically accommodated in the openings 411;421 and having the respective roller axles 401 respectively pivotally coupled to the pivot holes 412;422 in the top guard frame wall 41 and the bottom guard frame wall 42. Thus, a gap of a predetermined height is defined between the rollers 40 at the top guard frame wall 41 and the rollers 40 at the bottom guard frame wall 42 for guiding the interlocking series of teeth 2 at the two zipper tapes 1 into positive engagement with less friction resistance.

What is claimed is:

1. A double layer zipper, comprising:

two zipper tapes, an interlocking series of teeth at each of opposing top and bottom sides of each of said two zipper tapes, each said interlocking series of teeth comprising a left-handed or right-handed series of coils, each said coil comprising a coil head and a coil body connected to a front side of said coil head, and a zipper slider coupled to the interlocking series of teeth at said two zipper tapes and movable to open/close the interlocking series of teeth at said two zipper tapes, said zipper slider comprising opposing top guard frame wall and bottom guard frame wall, a division wall vertically connected between said top guard frame wall and said bottom guard frame wall and a nose located on a top side of said top guard frame wall;

wherein:

said coil body comprises a recessed face disposed adjacent to the associating coil head, two flank portions disposed at two opposite lateral sides of said recessed face, and a neck connected between said recessed face and associating coil head so that each said coil has a tadpole-shaped profile;

each said zipper tape comprises a seal strip covered on transverse top and bottom edges and one longitudinal side edge thereof and stitched with the associating interlocking series of teeth;

said zipper slider further comprises two openings respectively cut through said top guard frame wall and said bottom guard frame wall, a plurality of pivot holes respectively formed in said top guard frame wall and said bottom guard frame wall and kept in communication with said openings at two opposite lateral sides, and a plurality of rollers respectively symmetrically accommodated in said openings pivotally coupled to said pivot holes in said top guard frame wall and said bottom guard frame wall.

2. The double layer zipper tape as claimed in claim 1, wherein the seal strip of each said zipper tape is affixed to the respective zipper tape by a coating technique, or fastened thereto during weaving of the respective zipper tape, or formed by twisting threads of the respective zipper tape into a cord to seal one longitudinal side edge of the respective zipper tape.

3. The double layer zipper tape as claimed in claim 2, wherein the seal strip of each said zipper tape is made by flexible plastics or rubber.

4. The double layer zipper tape as claimed in claim 1, wherein the seal strip of each said zipper tape is formed on transverse top and bottom edges and one longitudinal side edge of the respective zipper tape by means of film-coating and then stitched up with the respective interlocking series of teeth.

5. The double layer zipper tape as claimed in claim 1, wherein the seal strips of said zipper tapes are abutted against each other when the interlocking series of teeth at said two zipper tapes are meshed together.

6. The double layer zipper tape as claimed in claim 1, wherein said nose of said zipper slider has a front bottom edge thereof stopped at a front side of the opening in said top guard frame wall to prohibit falling of the respective rollers out of the opening in said top guard frame wall; the opening in said bottom guard frame wall has a front end thereof closed and flanged to prohibit falling of the respective rollers out of the opening in said bottom guard frame wall.

* * * * *